US010975830B2

(12) United States Patent
Cress

(10) Patent No.: US 10,975,830 B2
(45) Date of Patent: Apr. 13, 2021

(54) SYSTEM AND METHOD FOR ENGINE IGNITION COIL IDENTIFICATION

(71) Applicant: Caterpillar Inc., Deerfield, IL (US)

(72) Inventor: James J. Cress, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 26 days.

(21) Appl. No.: 16/355,033

(22) Filed: Mar. 15, 2019

(65) Prior Publication Data

US 2020/0291915 A1 Sep. 17, 2020

(51) Int. Cl.

| | |
|---|---|
| ***F02P 17/10*** | (2006.01) |
| ***F02P 17/12*** | (2006.01) |
| ***F02P 3/05*** | (2006.01) |
| ***F02P 3/045*** | (2006.01) |

(52) U.S. Cl.

CPC ..... *F02P 17/10* (2013.01); *F02P 3/045* (2013.01); *F02P 3/05* (2013.01); *F02P 17/12* (2013.01)

(58) Field of Classification Search

CPC .. F02P 17/10; F02P 3/045; F02P 17/12; F02P 3/05

See application file for complete search history.

(56) References Cited

U.S. PATENT DOCUMENTS

| | | | | |
|---|---|---|---|---|
| 4,773,380 | A | 9/1988 | Narita et al. | |
| 4,836,175 | A * | 6/1989 | Hansen | F02P 3/0456 123/609 |
| 5,446,385 | A * | 8/1995 | Kugler | F02P 3/0554 123/644 |
| 6,100,710 | A | 8/2000 | Monnot | |
| 6,820,602 | B1 | 11/2004 | Masters et al. | |
| 9,920,736 | B2 | 3/2018 | Tang et al. | |
| 2014/0109886 | A1* | 4/2014 | Singleton | F02P 23/04 123/594 |
| 2016/0222939 | A1* | 8/2016 | Tang | F02P 3/0442 |
| 2018/0258902 | A1* | 9/2018 | Kienzle | F02P 3/04 |

* cited by examiner

*Primary Examiner* — Joseph J Dallo
(74) *Attorney, Agent, or Firm* — Bookoff McAndrews

(57) ABSTRACT

An ignition system for an internal combustion engine includes an ignition coil forming a part of a primary circuit and a secondary circuit, a power source to supply power to the ignition coil, and a controller to determine whether the ignition coil is a recognized ignition coil based on a measured risetime and a measured current level in the primary circuit, the measured current level being lower than that required to create a breakdown voltage of the ignition coil.

20 Claims, 2 Drawing Sheets

SYSTEM AND METHOD FOR ENGINE IGNITION COIL IDENTIFICATION

TECHNICAL FIELD

The present disclosure relates generally to engine ignition coils, and more particularly, to a system and method for identifying engine ignition coils.

BACKGROUND

Engine ignition coils are used in internal combustion engines to produce a high voltage, which is necessary to create an electric spark with a spark plug to ignite fuel in combustion chambers of the engine. Ignition coils generally include two coils of wire and a central core. The first, or primary coil includes a winding having only a few turns of wire, and the second, or spark coil includes a winding around the core having many turns of wire. Generally, the primary coil is electrically connected to a primary circuit that provides controlled current through the primary coil. The spark coil forms part of a second circuit that includes the spark plug.

In capacitive discharge ignition systems, a power source and charge capacitor is included in the primary circuit and controlled to deliver energy to the primary coil in synchronism with rotation of the engine crankshaft. As the current is supplied to the primary coil, voltage builds at the spark coil and eventually reaches a level that initiates a spark across an air gap of the spark plug to ignite the fuel in the combustion chamber.

Different ignition coils have different impedance values. Based on this, different ignition coils require current to be applied for a different time period to generate the voltage necessary to initiate a spark at the spark plug. This time period of supplying current to the primary coil is referred to as the risetime, and the voltage in the spark coil necessary to initiate a spark is referred to as the breakdown voltage of the ignition coil. Thus, different ignition coils have different breakdown voltage risetimes. Applying current in the first winding for too short or too long a duration may prevent the ignition coil reaching the breakdown voltage, or may over energize the system causing the ignition coil to fail prematurely.

U.S. Pat. No. 4,773,380, issued to Denso Corporation on Sep. 27, 1988 ("the '380 patent"), describes a current flowing time period control system for an ignition coil of an internal combustion engine. The system in the '380 patent uses a current flowing time period setting circuit to set the time period for supplying a primary current of the ignition coil and an output signal of the circuit is amplified by a drive circuit and supplied to a power transistor that turns on and off the primary current to the ignition coil to control the ignition operation of the engine. The '380, however, does not address identification and control of different ignition coils in an engine.

The ignition system of the present disclosure may solve one or more of the problems set forth above and/or other problems in the art. The scope of the current disclosure, however, is defined by the attached claims, and not by the ability to solve any specific problem.

SUMMARY OF THE DISCLOSURE

According to an embodiment, an ignition system for an internal combustion engine includes an ignition coil forming a part of a primary circuit and a secondary circuit, a power source to supply power to the ignition coil, and a controller to determine whether the ignition coil is a recognized ignition coil based on a measured risetime and a measured current level in the primary circuit, the measured current level being lower than that required to create a breakdown voltage of the ignition coil.

According to another embodiment, a method of operating an ignition system for an internal combustion engine includes providing power to an ignition coil forming a part of a primary circuit and a secondary circuit, measuring a risetime in the primary circuit to a predetermined current level, determining whether the ignition coil is a recognized ignition coil based on the measured risetime, and operating the internal combustion engine with a breakdown voltage risetime corresponding to the recognized ignition coil, if the ignition coil is recognized.

According to yet another embodiment, a non-transitory machine-readable medium stores instructions that, when executed by a controller of an internal combustion engine system, causes the engine system to perform a method for operating an ignition system for an internal combustion engine, the method includes providing power to an ignition coil forming a part of a primary circuit and a secondary circuit, measuring a risetime in the primary circuit to a predetermined current level, determining whether the ignition coil is a recognized ignition coil based on the measured risetime, and operating the internal combustion according to a breakdown voltage risetime corresponding to the recognized ignition coil, if the ignition coil is recognized.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, relative terms, such as, for example, "about," "substantially," "generally," and "approximately" are used to indicate a possible variation of ±10% in a stated value or characteristic.

Figure 1:
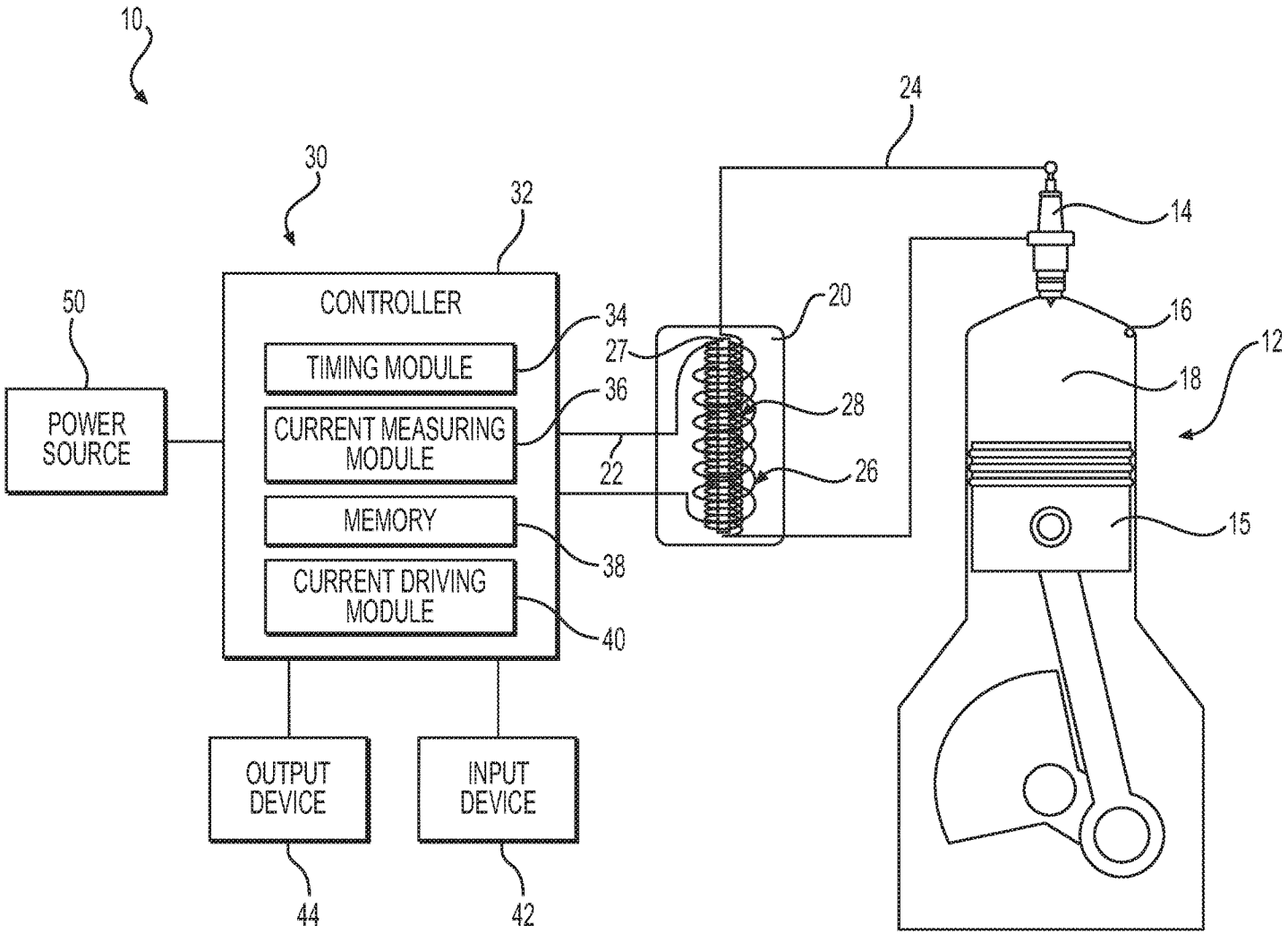
FIG. 1 is a schematic diagram of an internal combustion engine system for identifying ignition coils, according to an embodiment of the disclosure.

FIG. 1 illustrates an engine system 10 including an engine cylinder 12, a spark plug 14 extending into the engine cylinder 12, and an ignition coil 20 for providing the necessary voltage across spark plug 14. An ignition coil control system 30 is coupled to ignition coil 20 to control the supply of current to ignition coil 20. Control system 30 may include a controller 32 including, for example, a timing module 34, a current measuring module 36, a memory 38, and a current driving module 40. Input and output devices 42, 44 may be coupled to controller 32 to facilitate the conveying of information to and from controller 32. Engine system 10 may further include a power source 50 coupled to control system 30.

Engine system 10 may include one or more engine cylinders 12 of any conventional design. For example, engine cylinder 12 may include a piston 15 reciprocating within a cylinder 16 forming a combustion chamber 18. Spark plug 14 may be of any conventional design and may be located in any appropriate location in order to initiate combustion within combustion chamber 18. It is understood that engine cylinder 12 may include appropriate intake and exhaust valving and fuel delivery systems (not show) as is known in the art.

Ignition coil 20 includes a primary winding 26 and a secondary winding 28, with each forming part of a primary circuit 22 and a secondary circuit 24, respectively. Primary circuit 22 may be connected to controller 32 and power source 50. Secondary circuit 24 may be connected to spark plug 14, and secondary winding 28 may extending about an iron core 27. Primary winding 26 includes a smaller number of loops than secondary winding 28. The difference in loops between primary winding 26 and secondary winding 28 is configured to develop an impedance that provides the necessary breakdown voltage to create a spark at an air gap of the spark plug 14. Different ignition coils have different winding configurations, thus different impedance values, and different breakdown voltage characteristics. Based on this, different ignition coils 20 are controlled differently.

Controller 32 of ignition coil control system 30 may be a dedicated controller, or may be a module within a controller that controls additional aspects of engine system 10 and/or controls features of a machine associated with engine system 10. Controller 32 may include various hardware (e.g., or more microprocessors, switches, capacitors, memory, etc.) and software and firmware for executing various functions, such as those provided in FIG. 2. As discussed above and shown in FIG. 1, controller 32 may include a timing module 34, a current measuring module 36, a memory 38, and a current driving module 40. The modules may be hardware or software modules, as is known in the art. Timing module 34 may be configured to measure timings associated with the ignition coil control system 30, and may be any analog or digital timer capable of determining a time period in response to receiving a specific signal. Timing module 34 may further be configured to communicate with external timing devices, for example timing devices based on Global Navigation Satellite System (GNSS), Internet Time, or the like to ensure accuracy of timing.

Current measuring module 36 may be used for measuring an amount of current in primary winding 26 of primary circuit 22, or a current related thereto. Current measuring module 36 may be any analog or digital sensor known in the art for measuring current, such as an ammeter, and may generate a signal proportional to the current in the wire being measured. Current measuring module may configured to measure current at the primary winding 26 or at any other location of primary circuit 22.

Memory 38 may store, inter alia, data measured by engine system 10 and/or data input by a user or originally stored thereon. Memory 38 may be a random access memory (RAM) or other dynamic storage device, a read-only memory or other static storage device. Alternately or in addition, memory 38 may include a storage device, for instance, a magnetic disk or optical disk, a solid state drive (SSD), etc. As will be explained in more detail below, memory 38 may store values such as the breakdown voltage risetime for one or more ignition coils 20, and a table, chart, or other data compilation associating a breakdown voltage risetime with a measured risetime to a predetermined current value in primary circuit 22.

The current driving module 40 of controller 32 may be any circuitry or software for controlling the current in primary circuit 22. For example, current driving module 40 may include one or more capacitors, diodes, switches, etc. that control the timing and amount of current supplied through primary circuit 22. Driving module 40 may use information from memory 38, timing module 34, and/or various other inputs and/or outputs to assist in controlling the timing and amount of current in primary circuit 22.

Input device 42 may be any device for allowing a user or service technician to input information into controller 32. For example, input device 42 may be a user console (not shown) of a machine associated with engine system 10. Additionally, or alternatively, input device 42 may be a user device (not shown), such as a handheld device or any other actuator, or a remote device having, e.g., a Bluetooth™ connection, AirDrop™, wireless Internet, and/or any other suitable device or connection, to provide an input to controller 32.

Output device 44 may be any device for communicating with a user or another device. For example, output device 44 may be a user display of a machine associated with engine system 10, and/or a transmitter for transmitting information to a remote location, such as a back end manufacturing server via, e.g., the Internet. Output device 44 may generate a notification, such as an error signal (or other feedback), which may be generated as, e.g., an audio, visual, or haptic feedback.

Power source 50 provides power to primary circuit 22. For example, power source 50 may be a battery configured to output a low-voltage current, e.g., a calcium-calcium battery, a lead-acid battery, a lithium ion battery, etc. Power source 50 may be any other appropriate power source, such as a generator, or other power supplying system sufficient to provide the energy required to establish the required current in primary circuit 22.

INDUSTRIAL APPLICABILITY

Engine system 10 may be used in any engine system known in the art. For example, engine system 10 may be used in any spark-ignited engine system having at least one ignition coil.

With continued reference to FIG. 1, the general operation of engine system 10 will be described as a precursor to a discussion of the ignition coil identification system of the present disclosure. As piston 15 reciprocates within cylinder 16 during a compression stroke, a fuel and air mixture within combustion chamber 18 is compressed. As piston 15 approaches top-dead-center of the cylinder 16, ignition coil 20 is controlled to create a breakdown voltage across the secondary circuit 24 to create a spark at spark plug 14. The spark at spark plug 14 ignites the fuel and air mixture within combustion chamber 18, thereby expanding gases contained within combustion chamber 18. The expansion of gasses within combustion drives a power stroke of the piston 15, which in turn drives the crankshaft of the engine system 10.

The high, breakdown voltage created across secondary circuit 24 by ignition coil 20 may be achieved in any conventional manner, such as with a capacitive discharge system, as will be discussed below. In such a system, one or more capacitors are controlled, for example by current driving module 40, to provide current to primary circuit 22 of ignition coil 20. As current is applied to primary circuit 22, primary winding 26 is charged, generating a magnetic field in ignition coil 20. When the primary winding has been charged to an appropriate amount, a voltage is established across the secondary circuit 24 sufficient to generate a spark across an air gap of the spark plug 14. As noted above, this voltage is referred to as the breakdown voltage of the ignition coil 20 (or secondary circuit 24), and is much higher than the voltage across the primary circuit 22. Once the breakdown voltage is achieved, the supply of current to primary circuit 22 is terminated.

The current in primary circuit 22 is supplied for a duration sufficient to generate an electromagnetic field that will create the necessary breakdown voltage across secondary circuit 24. The amount of time that current is provided to the primary circuit 22 is called the risetime, and as noted above, the breakdown voltage risetime is the duration necessary to initiate a spark at spark plug 24. The breakdown voltage risetime may be different for different configurations of ignition coils 20. This is because differently configured ignition coils 20 have different impedance values. As noted above, the breakdown voltage risetime may be a stored value in memory 38 of controller 32, and the risetime may be tracked by timing module 34 of controller 32.

Figure 2:
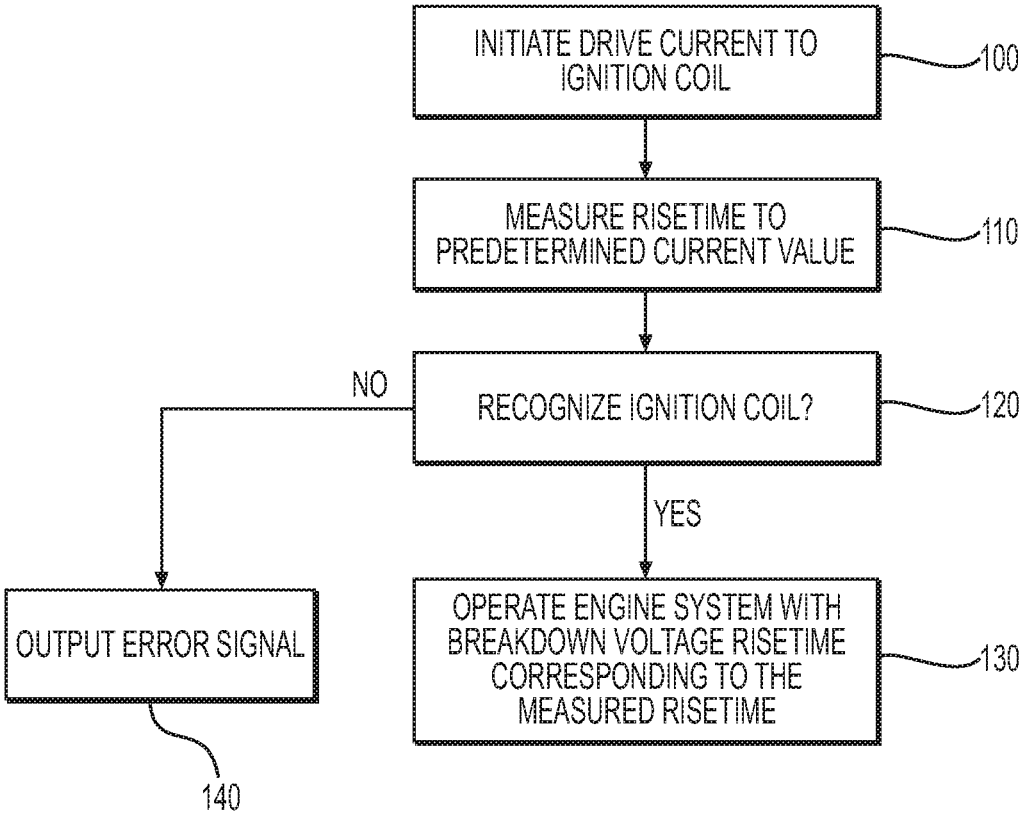
FIG. 2 is a flow chart of the ignition coil identification system according to an embodiment of the disclosure.

FIG. 2 will now be described in connection with the ignition coil identification system of the present disclosure. In step 100, a drive current is initiated in the ignition coil 20. The initiation of the drive current may be solely for the purposes of coil identification and/or could be part of the normal operation of the ignition coil 20 during power operation of the engine system 10. If solely for the purpose of coil identification, the initiation of the drive current may take place during engine set-up, during engine servicing or maintenance, and/or each time the engine is started. The drive current may be initiated by current driving module 40 of controller 32 as discussed above. The driving module 40 may use, for example, power source 50, one or more capacitors (not shown), and/or one or more diodes or switches to initiate the current to the primary circuit 22 of ignition coil 20. The initiation of the drive current to the ignition coil (step 100) serves to raise the current in the primary winding 26 over time. While the current is building in primary winding 26, timing module 34 measures the risetime.

In Step 110, while the timing module 34 is measuring the risetime, the current measuring module 36 measures the current in primary circuit 22, for example in primary winding 26. Once the measured current in primary circuit 22 reaches a predetermined current value, the measured risetime is recorded. The predetermined current value may be a stored value in memory 38, and the value is lower than that sufficient to form a breakdown voltage in ignition coil 20.

In Step 120, controller 32 determines whether the ignition coil 20 is recognized. As used herein, recognizing the ignition coil 20 may include recognizing only a single ignition coil 20 as the proper or desired coil 20 for the engine system 10. Alternatively, recognizing the ignition coil 20 may be a recognition of one of a plurality of ignition coils that may be acceptably used in the engine system 10. This step 120 of recognizing the ignition coil may include comparing the measured risetime to reach the predetermined current value to an expected risetime to reach the predetermined current value, where the expected risetime may be stored in memory 38. If the measured risetime matches an expected risetime, then the ignition coil 20 is recognized. It is understood that in an alternative aspect, the risetime may be the predetermined value, and the measured current of the primary circuit 22 at the end of the predetermined risetime may be recorded and compared to a stored, expected current value to determine recognition of the ignition coil 20.

Once recognized, the system may operate the engine system 10 using a breakdown voltage risetime stored in memory 38 corresponding to the measured risetime (Step 130). In the situation where there are a plurality of different ignition coils 20 that may be recognized, the controller 32 is configured to select between different breakdown voltage risetimes stored in memory 38 for engine operation, based on the different measured risetimes to the predetermined current value.

In Step 140, if ignition coil 20 is not a recognized ignition coil, a signal may be sent from controller 32 to output device 44 indicating that the ignition coil is not proper. The generated output may be any appropriate notification, such as an error, warning, or other information or signal conveyed by output device 44, e.g., via audible, visual, or haptic output. Output device 44 may also inform a user of the characteristics of the proper ignition coil 20 including, but not limited to, a manufacturer name and model number. In addition or alternatively, the engine system 10 may be programmed to not allow operation of engine system 10 due to the unrecognized ignition coil 20.

The ignition coil identification system of the current disclosure assists in ensuring that an appropriate breakdown voltage risetime is used for the currently installed ignition coil 20. Thus, the system may help ensure efficient engine operation and appropriate life of the ignition coil 20. Further, the ignition coil identification system of the present disclosure may also allow for switching of one ignition coil 20 with an another ignition coil 20 having a different impedance value, recognition of a new ignition coil 20, and automatic adjustment of the breakdown voltage risetimes based on the new ignition coil 20. In such an arrangement, the controller 32 may be configured to receive from input device 42 new breakdown voltage risetimes and corresponding measured risetimes to a predetermined current level.

It will be apparent to those skilled in the art that various modifications and variations can be made to the disclosed device without departing from the scope of the disclosure. Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An ignition system for an internal combustion engine, comprising:

an ignition coil forming a part of a primary circuit and a secondary circuit;

a power source configured to supply power to the ignition coil; and a controller configured to determine whether the ignition coil is a recognized ignition coil based on a measured risetime and a measured current level in the primary circuit, the measured current level being lower than that required to create a breakdown voltage of the ignition coil.

2. The ignition system of claim 1, wherein the ignition coil is a recognized ignition coil based on the measured risetime to a predetermined current level.

3. The ignition system of claim 1, wherein the controller is further configured to create a notification if the ignition coil is not recognized.

4. The ignition system of claim 1, wherein the controller is configured to determine a proper breakdown voltage risetime based on the measured risetimes and measured current level.

5. The ignition system of claim 2, wherein the ignition coil is the recognized ignition coil based further on the measured risetime being equal to an expected risetime to reach the predetermined current value.

6. The ignition system of claim 5, wherein the controller includes a timing module to measure the risetime, and a current measuring module to measure the current level in the primary circuit.

7. The ignition system of claim 1, wherein the controller is configured to determine whether the ignition coil is a recognized ignition coil each time the internal combustion engine is started.

8. A method of operating an ignition system for an internal combustion engine, comprising:

providing power to an ignition coil forming a part of a primary circuit and a secondary circuit;

measuring a risetime in the primary circuit to a predetermined current level;

determining whether the ignition coil is a recognized ignition coil based on the measured risetime; and operating the internal combustion engine with a breakdown voltage risetime corresponding to the recognized ignition coil, if the ignition coil is recognized.

9. The method of claim 8, wherein the predetermined current level is lower than the breakdown voltage risetime.

10. The method of claim 8, further including creating a notification if the ignition coil is not recognized.

11. The method of claim 10, further including providing the notification to an output device associated with the internal combustion engine.

12. The method of claim 8, further including not allowing operation of the internal combustion engine if the ignition coil is not recognized.

13. The method of claim 8, further including selecting, based on the measured risetime, a stored breakdown voltage risetime from a plurality of stored breakdown voltage risetimes.

14. The method of claim 8, wherein the determining of whether the ignition coil is a recognized ignition coil is performed as part of a servicing of the internal combustion engine.

15. A non-transitory machine-readable medium storing instructions that, when executed by a controller of an internal combustion engine system, causes the engine system to perform a method for operating an ignition system for an internal combustion engine, the method comprising:

providing power to an ignition coil forming a part of a primary circuit and a secondary circuit;

measuring a risetime in the primary circuit to a predetermined current level;

determining whether the ignition coil is a recognized ignition coil based on the measured risetime; and operating the internal combustion according to a breakdown voltage risetime corresponding to the recognized ignition coil, if the ignition coil is recognized.

16. The non-transitory machine-readable medium storing instructions of claim 15, wherein the predetermined current level is lower than the breakdown voltage risetime.

17. The non-transitory machine-readable medium storing instructions of claim 15, wherein the method further includes creating an notification if the ignition coil is not recognized.

18. The non-transitory machine-readable medium storing instructions of claim 17, wherein the method further includes providing the notification to an output device of the internal combustion engine.

19. The non-transitory machine-readable medium storing instructions of claim 15, wherein the method further includes not allowing operation of the internal combustion engine if the ignition coil is not recognized.

20. The non-transitory machine-readable medium storing instructions of claim 15, wherein the method further includes selecting, based on the measured risetime, a breakdown voltage risetime from a plurality of stored breakdown voltage risetime.

* * * * *